US007487805B2

(12) United States Patent
Barratte et al.

(10) Patent No.: US 7,487,805 B2
(45) Date of Patent: Feb. 10, 2009

(54) PAPERMAKER'S FORMING FABRIC WITH CROSS-DIRECTION YARN STITCHING AND RATIO OF TOP MACHINED DIRECTION YARNS TO BOTTOM MACHINE DIRECTION YARNS OF LESS THAN 1

(75) Inventors: Christine Barratte, Saint-Claude (FR); Stewart Hay, Raleigh, NC (US); Kevin John Ward, Coldbrook (CA)

(73) Assignee: Weavexx Corporation, Wake Forest, NC (US)

( * ) Notice: Subject to any disclaimer, the term of this patent is extended or adjusted under 35 U.S.C. 154(b) by 189 days.

(21) Appl. No.: 11/669,490

(22) Filed: Jan. 31, 2007

(65) Prior Publication Data

US 2008/0178958 A1 Jul. 31, 2008

(51) Int. Cl.

| | |
|---|---|
| ***D03D 3/04*** | (2006.01) |
| ***D21F 7/08*** | (2006.01) |
| *D21F 1/10* | (2006.01) |
| *D03D 25/00* | (2006.01) |

(52) U.S. Cl. ..... 139/383 A; 139/383 R; 139/408; 139/411; 139/412; 139/414; 162/348; 162/358.1; 162/358.2; 162/902; 162/903

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS 2,172,430 A 9/1939 Barrell (Continued)

FOREIGN PATENT DOCUMENTS

DE 454 092 12/1927

(Continued)

OTHER PUBLICATIONS

International Search Report and Written Opinion of the International Searching Authority of International Application No. PCT/US2007/022434 (12 pages) (Feb 8, 2008).

(Continued)

*Primary Examiner*—Bobby H Muromoto, Jr.
(74) *Attorney, Agent, or Firm*—Myers, Bigel, Sibley & Sajovec, P.A.

(57) ABSTRACT

A triple layer papermaker's fabric includes: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns. The top MD yarns and the top CMD yarns are interwoven in a series of repeat units and the bottom MD yarns and the bottom CMD yarns are interwoven in a series of corresponding repeat units. The set of top MD yarns comprises a first number of top MD yarns in each repeat unit, and the set of bottom MD yarns comprises a second number of bottom MD yarns in each repeat unit, wherein the second number being greater than the first number. Each bottom MD yarn follows a different interweaving pattern than that followed by each of its two immediate neighboring bottom MD yarns.

28 Claims, 12 Drawing Sheets

U.S. PATENT DOCUMENTS 2,554,034 A 5/1951 Koester et al.
3,094,149 A 6/1963 Keily
3,325,909 A 6/1967 Clark
4,093,512 A 6/1978 Fleischer
4,182,381 A 1/1980 Gisbourne
4,244,543 A 1/1981 Ericson
4,289,173 A 9/1981 Miller
4,290,209 A 9/1981 Buchanan et al.
4,414,263 A 11/1983 Miller et al.
4,438,788 A 3/1984 Harwood
4,452,284 A 6/1984 Eckstein et al.
4,453,573 A 6/1984 Thompson
4,501,303 A 2/1985 Osterberg
4,515,853 A 5/1985 Borel
4,529,013 A 7/1985 Miller
4,564,052 A 1/1986 Borel
4,564,551 A 1/1986 Best
4,592,395 A 6/1986 Borel
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A 4/1988 Borel
4,755,420 A 7/1988 Baker et al.
4,759,975 A 7/1988 Sutherland et al.
4,815,499 A 3/1989 Johnson
4,815,503 A 3/1989 Borel
4,909,284 A 3/1990 Kositzke
RE33,195 E * 4/1990 McDonald et al. ..... 139/425 A
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,152,326 A 10/1992 Vohringer
5,158,118 A 10/1992 Tate et al.
5,219,004 A 6/1993 Chiu
5,228,482 A 7/1993 Fleischer
5,277,967 A 1/1994 Zehle et al.
5,358,014 A 10/1994 Kovar
5,421,374 A 6/1995 Wright
5,421,375 A 6/1995 Praetzel
5,429,686 A 7/1995 Chiu et al.
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,641,001 A 6/1997 Wilson
5,651,394 A 7/1997 Marchand
5,709,250 A 1/1998 Ward et al.
RE35,777 E 4/1998 Givin
5,746,257 A 5/1998 Fry
5,826,627 A 10/1998 Seabrook et al.
5,857,498 A 1/1999 Barreto et al.
5,881,764 A * 3/1999 Ward ..... 139/383 A
5,894,867 A 4/1999 Ward et al.
5,899,240 A 5/1999 Wilson
5,937,914 A 8/1999 Wilson
5,967,195 A * 10/1999 Ward ..... 139/383 A
5,983,953 A 11/1999 Wilson
6,073,661 A 6/2000 Wilson
6,112,774 A 9/2000 Wilson
6,123,116 A 9/2000 Ward et al.
6,145,550 A * 11/2000 Ward ..... 139/383 A
6,148,869 A 11/2000 Quigley
6,158,478 A 12/2000 Lee et al.
6,179,965 B1 1/2001 Cunnane et al.
6,202,705 B1 3/2001 Johnson et al.
6,207,598 B1 3/2001 Lee et al.
6,227,255 B1 5/2001 Osterberg et al.
6,237,644 B1 5/2001 Hay et al.
6,240,973 B1 6/2001 Stone et al.
6,244,306 B1 * 6/2001 Troughton ..... 139/383 A
6,253,796 B1 * 7/2001 Wilson et al. ..... 139/383 A
6,276,402 B1 8/2001 Herring
6,379,506 B1 4/2002 Wilson et al.
6,581,645 B1 6/2003 Johnson et al.
6,585,006 B1 7/2003 Wilson et al.
6,745,797 B2 * 6/2004 Troughton ..... 139/383 A
6,810,917 B2 * 11/2004 Stone ..... 139/383 A
6,837,277 B2 * 1/2005 Troughton et al. ..... 139/383 A
6,854,488 B2 * 2/2005 Hay et al. ..... 139/383 A
6,860,969 B2 * 3/2005 Troughton ..... 162/348
6,953,065 B2 * 10/2005 Martin et al. ..... 139/383 A
7,001,489 B2 2/2006 Taipale et al.
7,114,529 B2 * 10/2006 Johnson et al. ..... 139/383 A
7,124,781 B2 * 10/2006 Fahrer et al. ..... 139/383 A
7,243,687 B2 * 7/2007 Barratte ..... 139/383 A
7,275,566 B2 * 10/2007 Ward ..... 139/383 A
7,426,943 B2 * 9/2008 Ueda et al. ..... 139/383 A
2003/0010393 A1 1/2003 Kuji
2004/0079434 A1 4/2004 Martin et al.
2004/0102118 A1 5/2004 Hay et al.
2004/0118473 A1 * 6/2004 Hay et al. ..... 139/383 R
2004/0149343 A1 * 8/2004 Troughton et al. ..... 139/383 R
2004/0182464 A1 * 9/2004 Ward ..... 139/383 A
2005/0268981 A1 * 12/2005 Barratte ..... 139/383 A
2006/0231154 A1 * 10/2006 Hay ..... 139/383 A

FOREIGN PATENT DOCUMENTS

DE 3318960 A1 11/1984
DE 33 29 740 A1 3/1985
EP 0 048 962 B2 9/1981
EP 0 158 710 A1 10/1984
EP 0 185 177 B1 10/1985
EP 0 224 276 B1 12/1986
EP 0 264 881 B1 10/1987
EP 0 269 070 B1 11/1987
EP 0 284 575 B1 2/1988
EP 0 283 181 B1 3/1988
EP 0 350 673 B1 6/1989
EP 0 408 849 A2 5/1990
EP 0 408 849 A3 5/1990
EP 0 672 782 B1 3/1995

| | | | |
|---|---|---|---|
| EP | 0 794 283 | A1 | 9/1997 |
| FR | 2 597 123 | | 4/1986 |
| GB | 2157328 | A | 10/1985 |
| GB | 2245006 | A | 2/1991 |
| JP | 8-158285 | | 12/1994 |
| WO | WO 86/00099 | A1 | 1/1986 |
| WO | WO 89/09848 | A1 | 4/1989 |
| WO | WO 03/010304 | A2 | 11/1992 |
| WO | WO 99/61698 | A1 | 12/1999 |
| WO | WO 02/00096 | A2 | 1/2002 |
| WO | WO 03/093573 | A1 | 11/2003 |

OTHER PUBLICATIONS

International Search Report for PCT/US2004/008311.

International Search Report for PCT Application No. PCT/US97/18629.

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

European Search Report corresponding to application No. EP 05002306.8, dated Oct. 18, 2005.

* cited by examiner

Wearside weave is 8MD X 8 CMD

X = binder position underneath a wearside warp

=wearside warp weaves underneath wearside weft

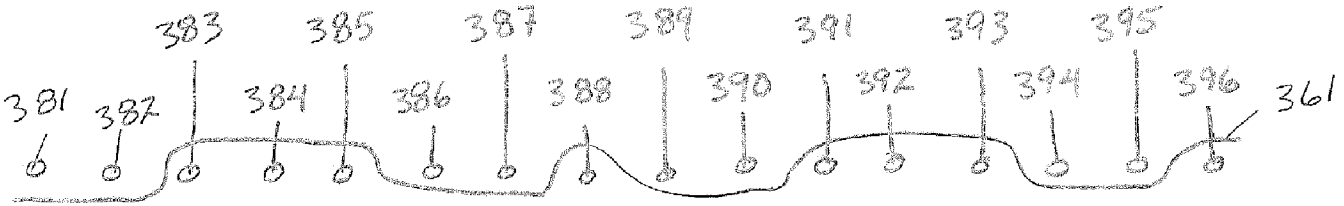
Fig. 10A
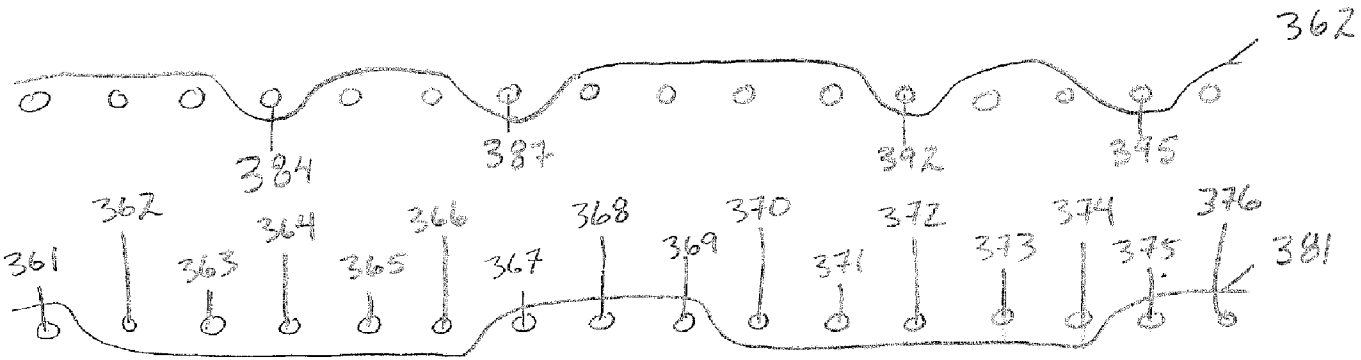
Fig. 10B
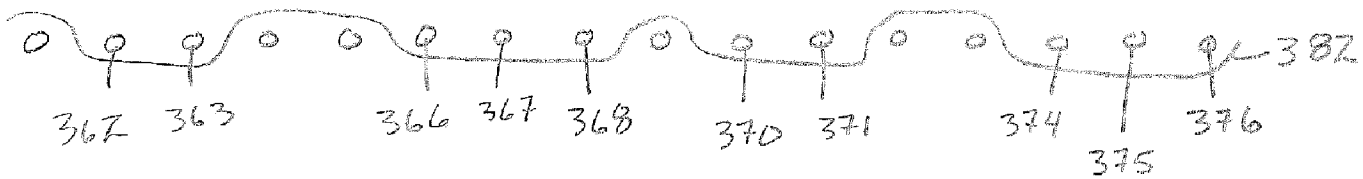
Fig. 11A
Fig. 11B

PAPERMAKER'S FORMING FABRIC WITH CROSS-DIRECTION YARN STITCHING AND RATIO OF TOP MACHINED DIRECTION YARNS TO BOTTOM MACHINE DIRECTION YARNS OF LESS THAN 1

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 5,967,195 to Ward discloses a triple layer fabric in which pairs of stitching yarns extend in the cross machine direction and form part of the papermaking surface, in essence "completing the weave" of the papermaking surface, while also stitching with the bottom layer. The fabrics disclosed in Ward have the same number of top machine direction yarns and bottom machine direction yarns. Such fabrics have proven to provide an excellent papermaking surface and to combat inter-layer wear. Although these fabrics have performed successfully in many applications, there is a trend toward finer yarns on the paper side of the fabric. However, because the tensile resistance of a yarn is proportional to the square of its diameter, as finer yarns are employed, the paper side layer of the fabric can become weaker. As such, fabric development continued to search for fabrics with sufficient drainage, particularly on the paper side, that still provide adequate fiber support for the production of many types of paper.

U.S. Patent Publication No. 2005/0268981 to Barratte discloses a fabric with CMD stitching yarn pairs that has twice as many bottom MD yarns as top MD yarns. U.S. Pat. No. 7,001,489 to Taipale et al. also discloses a fabric with twice as many bottom MD yarns as top MD yarns and with pairs of stitching yarns separated by a so-called substitute weft which also contributes to the top fabric weave pattern. The disclosures of the '981 application and the '489 patent are hereby incorporated herein in their entireties.

SUMMARY OF THE INVENTION

As a first aspect, embodiments of the present invention are directed to a triple layer papermaker's fabric comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns. The top MD yarns and the top CMD yarns are interwoven in a series of repeat units and the bottom MD yarns and the bottom CMD yarns are interwoven in a series of corresponding repeat units. The set of top MD yarns comprises a first number of top MD yarns in each repeat unit, and the set of bottom MD yarns comprises a second number of bottom MD yarns in each repeat unit, wherein the second number being greater than the first number. Each bottom MD yarn follows a different interweaving pattern than that followed by each of its two immediate neighboring bottom MD yarns.

In some embodiments, adjacent bottom MD yarns comprise a different type of interlacing and a different frequency of interlacings. In other embodiments, adjacent bottom MD yarns comprise the same type of interlacing but with a different frequency of interlacings. In still other embodiments, adjacent bottom MD yarns comprise different types of interlacing but with the same frequency of interlacings.

As a second aspect, embodiments of the present invention are directed to a triple layer papermaker's fabric comprising: a set of top MD yarns; a set of top cross machine direction CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns. The top MD yarns and the top CMD yarns are interwoven in a series of repeat units and the bottom MD yarns and the bottom CMD yarns are interwoven in a series of corresponding repeat units. The set of top MD yarns comprises a first number of top MD yarns in each repeat unit, and the set of bottom MD yarns comprises a second number of bottom MD yarns in each repeat unit, the second number being twice as great as the first number. Each bottom MD yarn follows a different interweaving pattern than that followed by each of its two immediate neighboring bottom MD yarns.

As a third aspect, embodiments of the present invention are directed to a method of making paper, comprising the steps of (a) providing a fabric of the structure described above, (b) applying paper stock to the fabric, and (c) removing moisture from the paper stock.

BRIEF DESCRIPTION OF THE FIGURES

FIGS. 10A and 10B are section views taken along lines 10A-10A and 10B-10B, respectively, of the bottom layer of the fabric of FIG. 9 showing typical bottom MD yarns.

FIGS. 11A and 11B are section views taken along lines 11A-11A and 11B-11B, respectively, of the bottom layer of the fabric of FIG. 9 showing typical bottom CMD yarns.

DETAILED DESCRIPTION OF EMBODIMENTS OF THE INVENTION

Figure 1A:
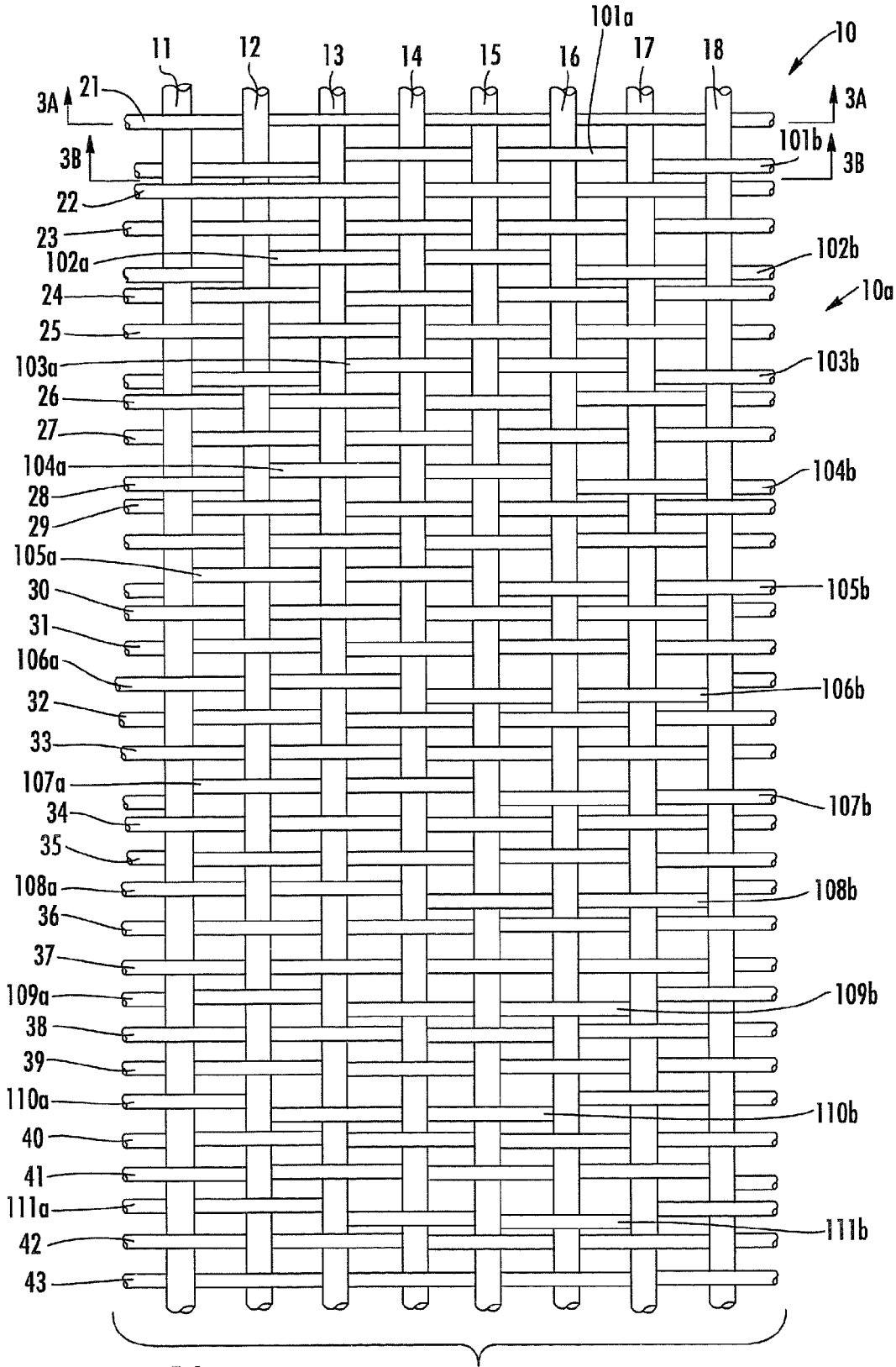
FIGS. 1A and 1B combine to form a top view of the top layer of a repeat unit of a fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an " and "the " are intended to include the plural forms as well, unless the context clearly indicates otherwise. It will be further understood that the terms "comprises " and/or "comprising, " when used in this specification, specify the presence of stated features, integers, steps, operations, elements, and/or components, but do not preclude the presence or addition of one or more other features, integers, steps, operations, elements, components, and/or groups thereof. As used herein the expression "and/or " includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Figure 1B:
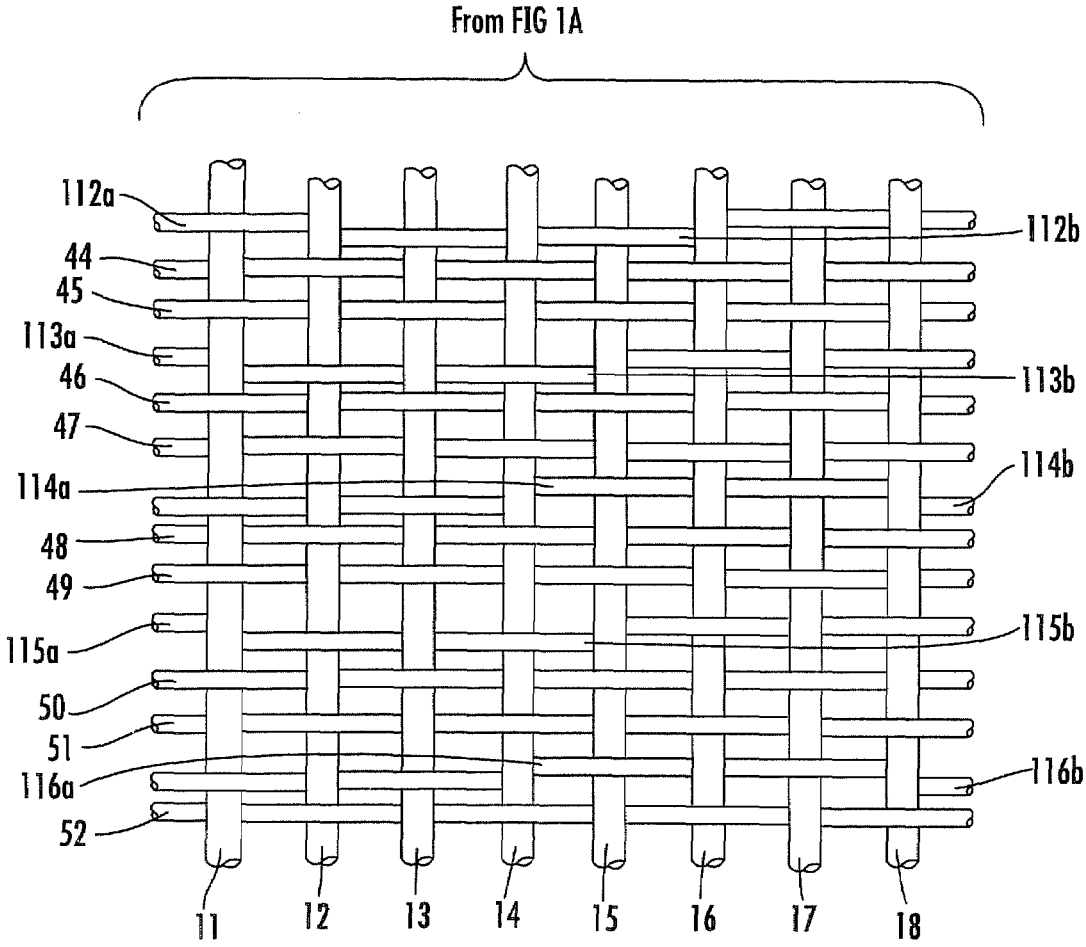
Figure 2:
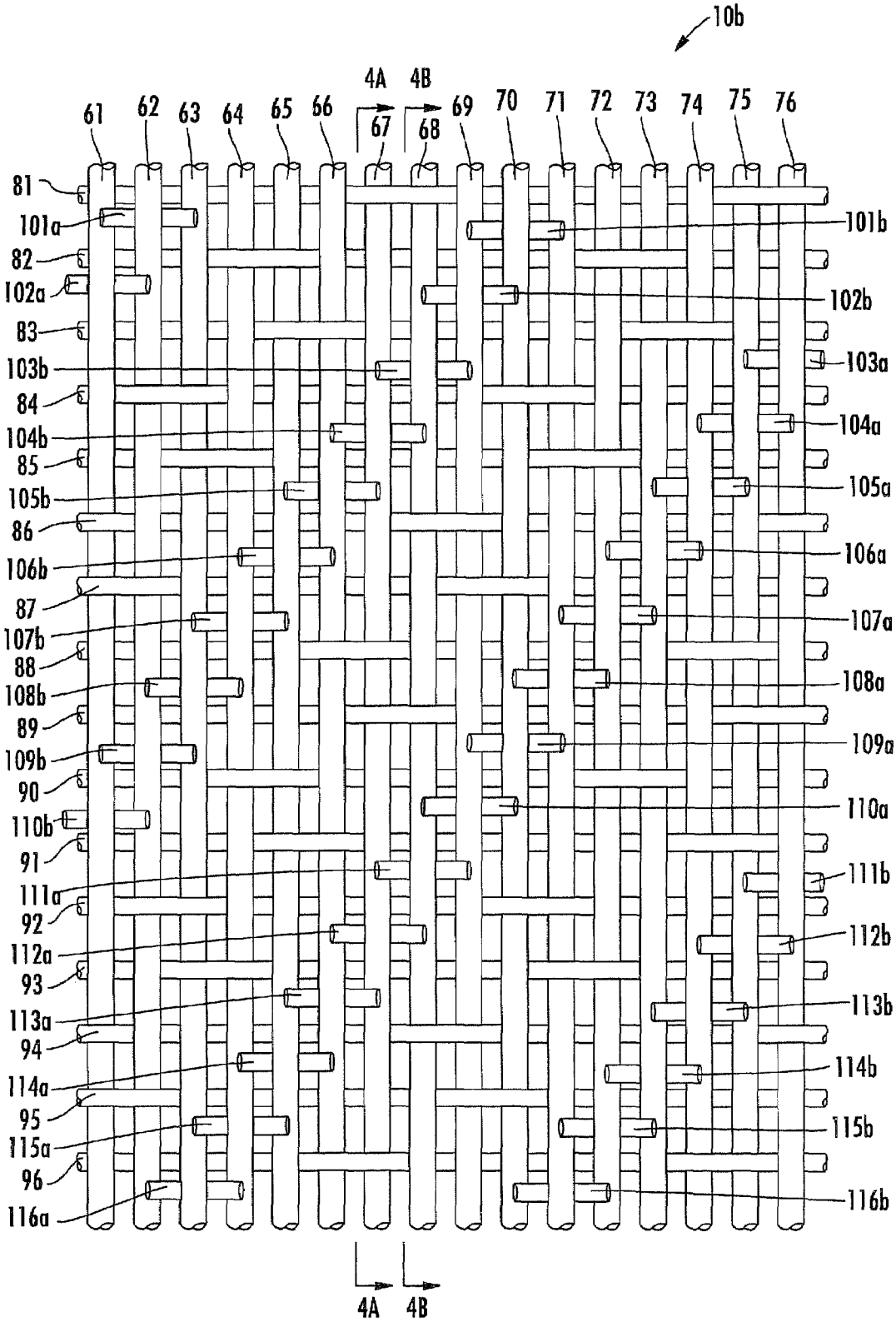
FIG. 2 is a top view of the bottom layer of the fabric of FIGS. 1A and 1B.

Referring now to the figures, a 24 harness triple layer forming fabric, generally designated at 10, is illustrated in FIGS. 1A, 1B and 2, in which a single repeat unit of the fabric is shown. The fabric 10 includes eight top MD yarns 11-18, thirty-two top CMD yarns 21-52, sixteen bottom MD yarns 61-72, sixteen bottom CMD yarns 81-96, and sixteen pairs of stitching yarns 101*a*, 101*b*-116*a*, 116*b*. The interweaving of these yarns is described in detail below.

Figure 3A:
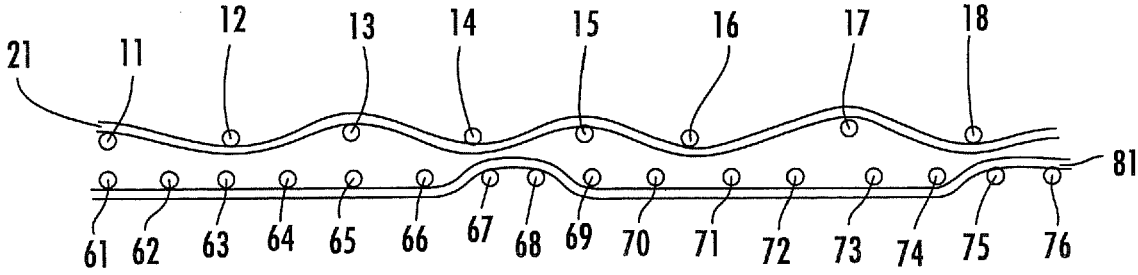
FIGS. 3A and 3B are section views taken along lines 3A-3A and 3B-3B, respectively, of the fabric of FIGS. 1A and 1B showing typical CMD yarns.
Figure 3B:
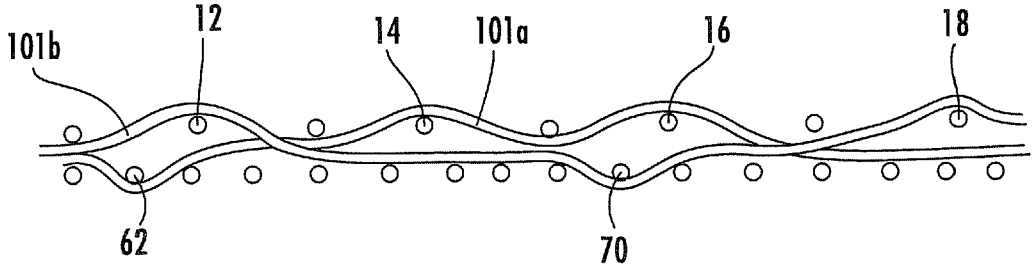

As seen in FIGS. 1A and 1B, the top layer 10*a* of the fabric 10 includes the top MD yarns 11-18 and the top CMD yarns 21-52 and portions of the stitching yarns 101*a*, 101*b*-116*a*, 116*b*. The top MD yarns and top CMD yarns are interwoven such that each top CMD yarn passes over and beneath top MD yarns in an alternating fashion. That is, each top CMD yarn either (a) passes under the odd-numbered top MD yarns 11, 13, 15 and 17 and over the even-numbered top MD yarns 12, 14, 16 and 18, or (b) passes over the odd-numbered top MD yarns 11, 13, 15, 17 and under the even-numbered top MD yarns 12, 14, 16, 18. For example, referring to FIG. 3A, top CMD yarn 21 passes over top MD yarn 11, under top MD yarn 12, over top MD yarn 13, under top MD yarn 14 and so on until it passes under top MD yarn 18. This same pattern is followed by the top CMD yarns 22, 25, 26, 29, 30, 33, 34, 37, 38, 41, 42, 45, 46, 49 and 50 as they interweave with the top MD yarns. The remaining top CMD yarns 23, 24, 27, 28, 31, 32, 35, 36, 39, 40, 43, 44, 47, 48, 51 and 52 follow the opposite weave pattern by passing under the odd-numbered top MD yarns 11, 13, 15, 17 and over the even-numbered top MD yarns 12, 14, 16, 18.

The top layer 10*a* (which includes the top MD yarns 11-18 and the top CMD yarns 21-52) and the bottom layer 10*b* (which includes the bottom MD yarns 61-76 and the bottom CMD yarns 81-96) are stitched together with the stitching yarns 101*a*, 101*b*-116*a*, 116*b*, which are arranged in pairs (see FIGS. 1A and 1B). The stitching yarn pairs are positioned between adjacent CMD yarns, with two top CMD yarns being located between each pair of stitching yarns. For example, the pair of stitching yarns 101*a*, 101*b* is positioned between top CMD yarns 21 and 22, and the pair of stitching yarns 102*a*, 102*b* is positioned between top CMD yarns 23 and 24.

As can be seen in FIGS. 1A, 1B, 2, 3A and 3B, corresponding pairs of stitching yarns interweave with the top MD yarns and bottom MD yarns in the following pattern. Each of the stitching yarns of the repeat unit can be subdivided into two portions: a fiber support portion which interweaves with the top MD yarns, and a binding portion which passes below the top MD yarns and, in the illustrated embodiment, interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of the "a " stitching yarn of each pair (e.g., 111*a*, 102*a*) interweaves in an alternating fashion with three top MD yarns (alternately passing over two top MD yarns and under the one top MD yarn between them), and the fiber support portion of the "b " stitching yarn of the pair (e.g., 101*b*, 102*b*) passes over two additional top MD yarns of the repeat unit while passing below the top MD yarn positioned between those two MD yarns. Both of the stitching yarns pass below the transitional top MD yarns.

In its fiber support portion, each stitching yarn 111*a*, 101*b*-116*a*, 116*b* passes over top MD yarns that the top CMD yarns adjacent to it pass beneath, and passes below top MD yarns that each adjacent top CMD yarn passes over (e.g., they pass under the even-numbered top MD yarns 12, 14, 16, 18). For example, the fiber support portion of stitching yarn 111*a* passes over top MD yarns 14 and 16 while passing under top MD yarn 15, and stitching yarn 101*b* passes over top MD yarns 18 and 12 while passing below top MD yarn 11. Both stitching yarns 101*a*, 101*b* pass below the transitional top MD yarns 13, 17. The remaining stitching yarn pairs weave in a similar manner, although they may be offset from adjacent stitching yarn pairs by one or more top MD yarns. In this manner, the stitching yarns 101*a*, 101*b*-116*a*, 116*b* and the top CMD yarns 21-52 form a plain weave pattern with the top MD yarns 11-18 (see FIGS. 1A and 1B).

Figure 4A:
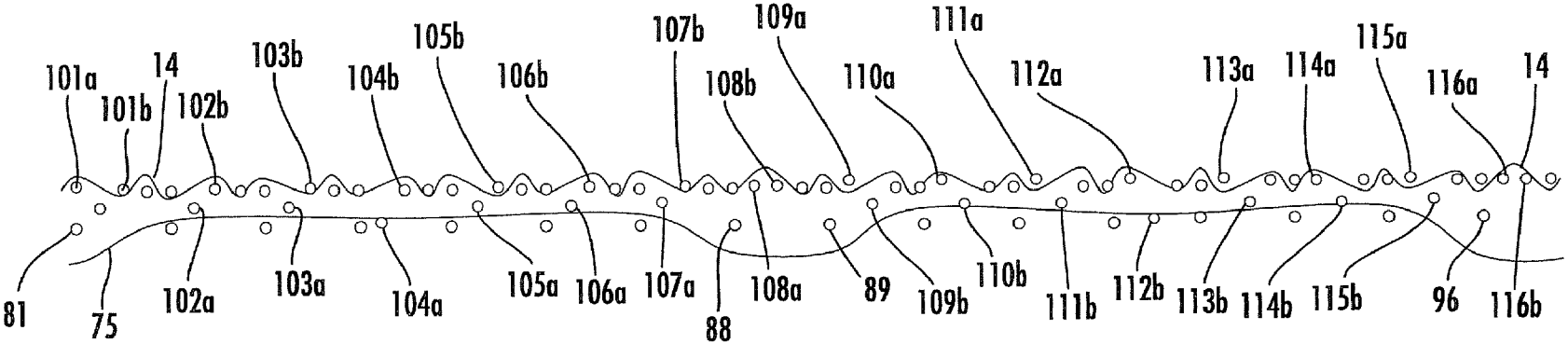
FIGS. 4A and 4B are section views taken along lines 4A-4A and 4B-4B, respectively, of the fabric of FIG. 2 showing typical MD yarns.

Referring now to FIG. 2, the bottom layer 10*b* of the fabric 10 includes the bottom MD yarns 61-76, the bottom CMD yarns 81-96, and the binding portions of the stitching yarns 111*a*, 101*b*-116*a*, 116*b*. The bottom MD yarns 61-76 are interwoven with the bottom CMD yarns 81-96 in two different sequences. The "odd-numbered" bottom MD yarns follow an "over 6/under 2/over 6/under 2" sequence. For example, referring to FIG. 4A, bottom MD yarn 75 passes above bottom CMD yarns 82-87, below bottom CMD yarns 88 and 89, above bottom CMD yarns 90-95, and below bottom CMD yarns 96 and 81. The other odd-numbered bottom MD yarns follow a similar "over 6/under 2/over 6/under 2" weave pattern relative to the bottom CMD yarns, but each is offset from its nearest odd-numbered bottom MD yarn neighbors by two bottom CMD yarns. Thus, the odd-numbered MD yarns enter or exit the bottom layer 10*b* on four occasions forming two distinct MD "floats", each floating under two adjacent bottom CMD yarns, on the underside of the bottom layer 10*b*.

Figure 4B:
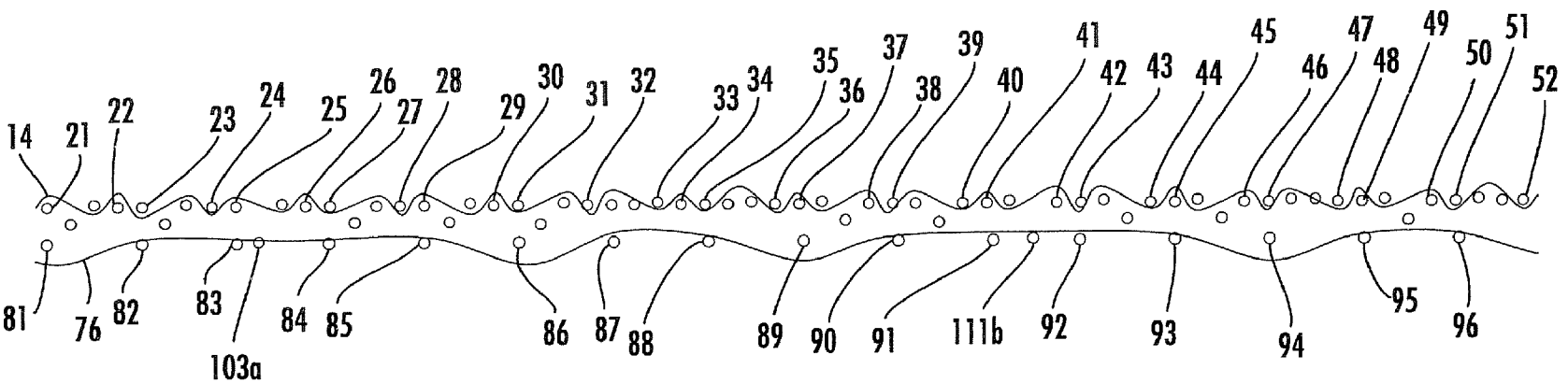

In contrast, the even-numbered bottom MD yarns follow an "over 4/under 1/over 2/under 1/over 4/under 1/over 2/under 1" sequence as they interweave with the bottom CMD yarns 81-96. For example, referring to FIG. 4B, bottom yarn 76 passes over bottom CMD yarns 82-85, under bottom CMD yarn 86, over bottom CMD yarns 87 and 88, under bottom CMD yarn 89, over bottom CMD yarns 90-93, under bottom CMD yarn 94, over bottom CMD yarns 95 and 96, and under bottom CMD yarn 81. The remaining even-numbered bottom MD yarns follow a similar weaving sequence, but are offset from their adjacent even-numbered neighbors by two bottom CMD yarns. Thus, the even-numbered MD yarns enter or exit the bottom fabric layer 10*b* on four occasions forming four distinct MD "knuckles", each knuckle being formed around a single bottom weft, on the underside of the bottom fabric layer 10*b*. By varying the interlacing frequency and/or type on distinct groups of bottom fabric warp yarns it is possible to adjust the fabric stability. This can become of increasing importance in fabrics with a high ratio of bottom fabric MD yarns to top fabric MD yarns as the diameter of the former group becomes, by necessity, relatively low compared to conventional fabrics.

Referring again to FIG. 2, as noted above, the bottom layer of the fabric 10 also includes the binding portions of the stitching yarns 101*a*, 101*b*-116*a*, 116*b*. In its binding portion, each stitching yarn 101*a*, 101*b*-116*a*, 116*b* passes below one bottom MD yarn in the repeat unit such that an "over 7/under 1" pattern is established by the pair of stitching yarns on the bottom surface of the fabric 10 (see FIGS. 2 and 3B). For example, stitching yarn 101*a* passes below bottom MD yarn 62, and stitching yarn 101*b* passes below bottom MD yarn 70; each of these stitching yarns pass above all of the other bottom MD yarns (see FIG. 3B). Thus, together stitching yarns 101*a* and 101*b* follow the aforementioned "over 7/under 1" sequence relative to the bottom MD yarns 81-96. The remaining stitching yarn pairs also follow the same "over 7/under 1" sequence, but are offset from adjacent stitching yarn pairs by one bottom MD yarn.

Referring once again to FIG. 2, despite the different interlacing pattern of the adjacent bottom MD yarns, each bottom CMD yarn follows a 2/6/2/6 pattern. For example, bottom CMD yarn 81 floats above two adjacent bottom MD yarns 75 and 76 and under six adjacent bottom MD yarns 74 to 69 before repeating this sequence with bottom MD yarns 68 to 61.

Another forming fabric according to embodiments of the invention, designated broadly at 200, is illustrated in FIGS. 5-8B. The fabric 200 includes eight top MD yarns 211-218, thirty-two top CMD yarns 221-252, sixteen bottom MD yarns 261-272, sixteen bottom CMD yarns 281-296, and sixteen pairs of stitching yarns 301*a*, 301*b*-316*a*, 316*b*. The interweaving of these yarns is described in detail below.

Figure 5A:
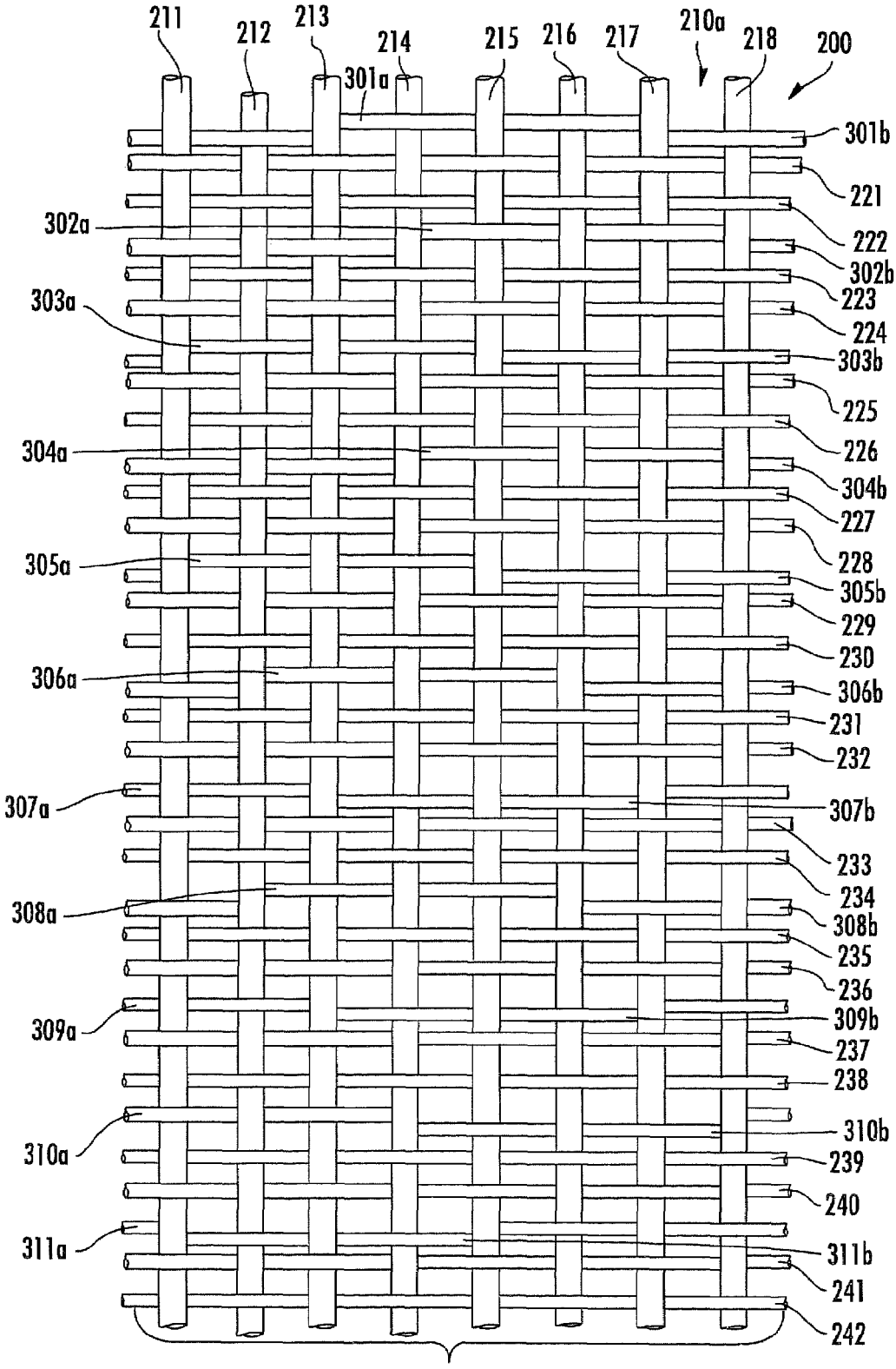
FIGS. 5A and 5B combine to form a top view of the top layer of a repeat unit of a fabric according to additional embodiments of the present invention.
Figure 5B:
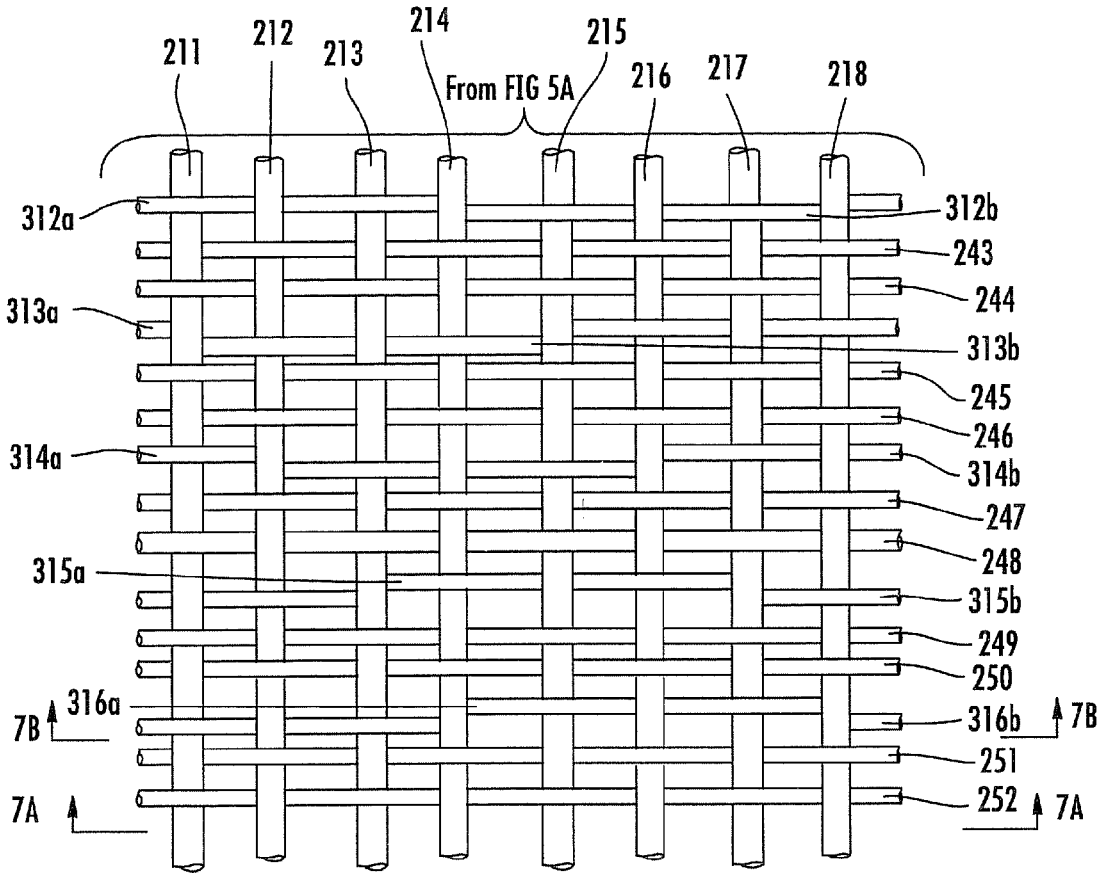

As seen in FIGS. 5A and 5B, the top layer 210*a* of the fabric 200 includes the top MD yarns 211-218 and the top CMD yarns 221-252 and portions of the stitching yarns 301*a*, 301*b*-316*a*, 316*b*. The top MD yarns and top CMD yarns are interwoven such that each top CMD yarn passes over and beneath top MD yarns in an alternating fashion. That is, each top CMD yarn either (a) passes under the odd-numbered top MD yarns 211, 213, 215 and 217 and over the even-numbered top MD yarns 212, 214, 216 and 218, or (b) passes over the odd-numbered top MD yarns 211, 213, 215, 27 and under the even-numbered top MD yarns 212, 214, 216, 218. For example, referring to FIG. 7A, top CMD yarn 251 passes under top MD yarn 211, over top MD yarn 212, under top MD yarn 213, over top MD yarn 214 and so on until it passes over top MD yarn 218. This same pattern is followed by the top CMD yarns 222, 223, 226, 227, 230, 231, 234, 235, 238, 239, 242, 243, 246, 247 and 250 as they interweave with the top MD yarns. The remaining top CMD yarns 221, 224, 225, 228, 229, 232, 233, 236, 237, 240, 241, 244, 245, 248, 249 and 252 follow the opposite weave pattern by passing over the odd-numbered top MD yarns 211, 213, 215, 217 and under the even-numbered top MD yarns 212, 214, 216, 218.

The top layer 210*a* (which includes the top MD yarns 211-118 and the top CMD yarns 221-252) and the bottom layer 210*b* (which includes the bottom MD yarns 261-276 and the bottom CMD yarns 281-296) are stitched together with the stitching yarns 301*a*, 301*b*-316*a*, 316*b*, which are arranged in pairs (see FIGS. 5A and 5B). The stitching yarn pairs are positioned between adjacent CMD yarns, with two top CMD yarns being located between each pair of stitching yarns. For example, the pair of stitching yarns 302*a*, 302*b* is positioned between top CMD yarns 222 and 223, and the pair of stitching yarns 303*a*, 303*b* is positioned between top CMD yarns 224 and 225. As can be seen in FIGS. 5, 6, 7A and 7B, corresponding pairs of stitching yarns interweave with the top MD yarns and bottom MD yarns in the same manner, with fiber support and binding portions, as the stitching yarns for the fabric embodiment shown in FIGS. 1-4B. For example, the fiber support portion of stitching yarn 316*a* passes over top MD yarns 211 and 213 while passing under top MD yarn 212, and stitching yarn 316*b* passes over top MD yarns 215 and 217 while passing below top MD yarn 216. Both stitching yarns 301*a*, 301*b* pass below the transitional top MD yarns 214, 218. The remaining stitching yarn pairs weave in a similar manner, although they may be offset from adjacent stitching yarn pairs by one or more top MD yarns. In this manner, the stitching yarns 301*a*, 301*b*-316*a*, 316*b* and the top CMD yarns 221-252 form a plain weave pattern with the top MD yarns 211-218 (see FIG. 5).

Figure 6:
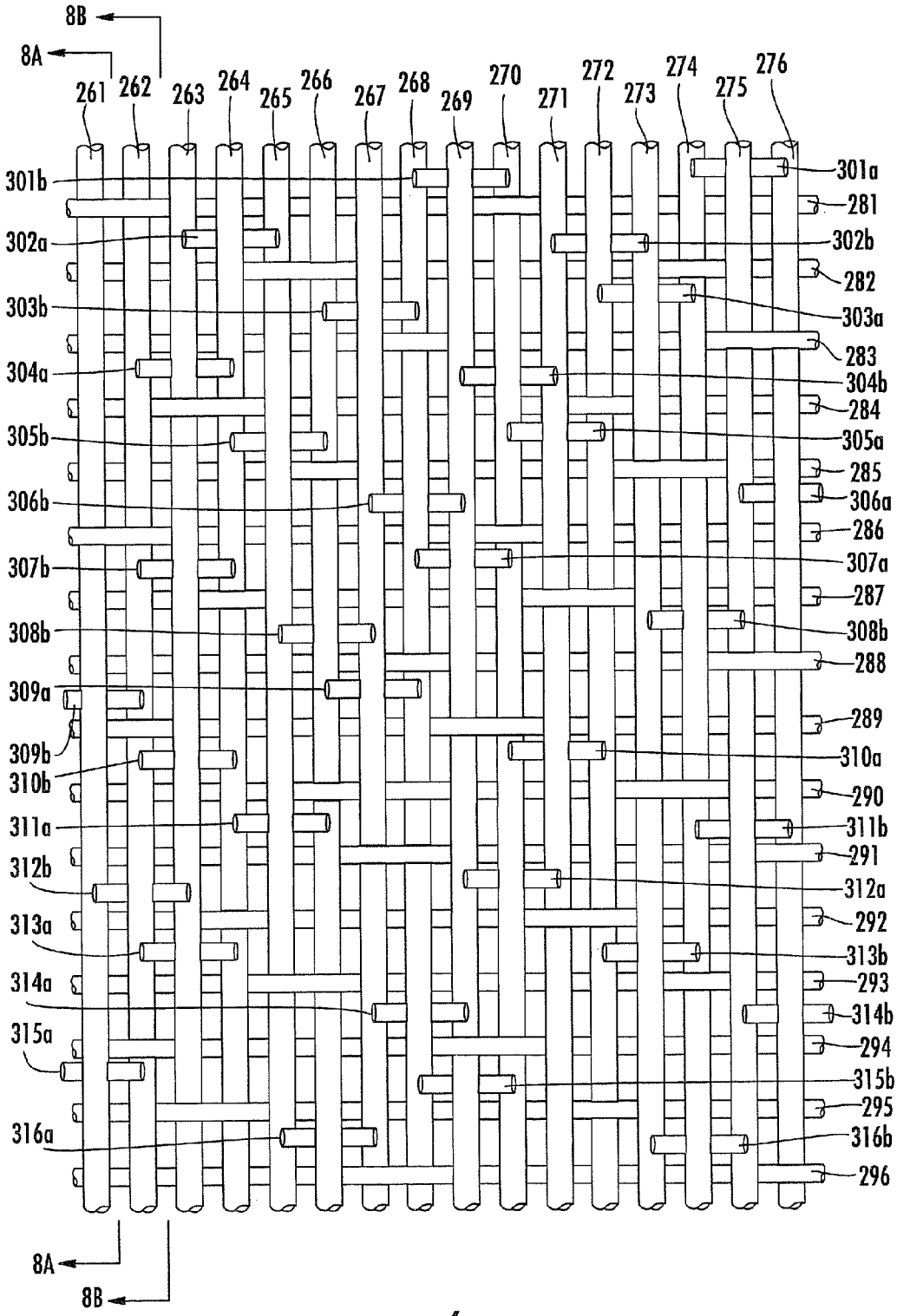
FIG. 6 is a top view of the bottom layer of the fabric of FIGS. 5A and 5B.
Figure 7A:
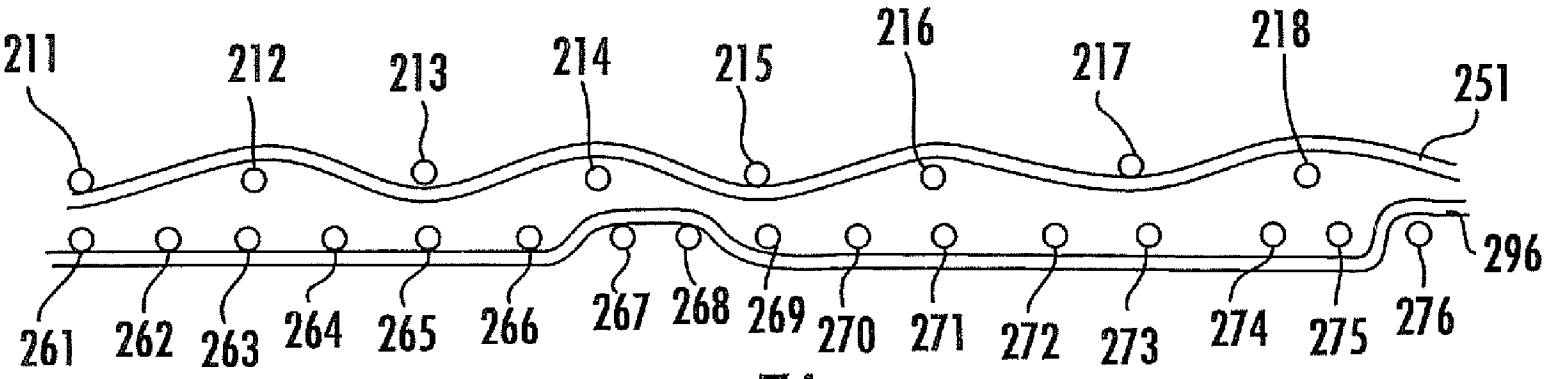
FIGS. 7A and 7B are section views taken along lines 7A-7A and 7B-7B, respectively, of the fabric of FIGS. 5A and 5B showing typical CMD yarns.
Figure 7B:
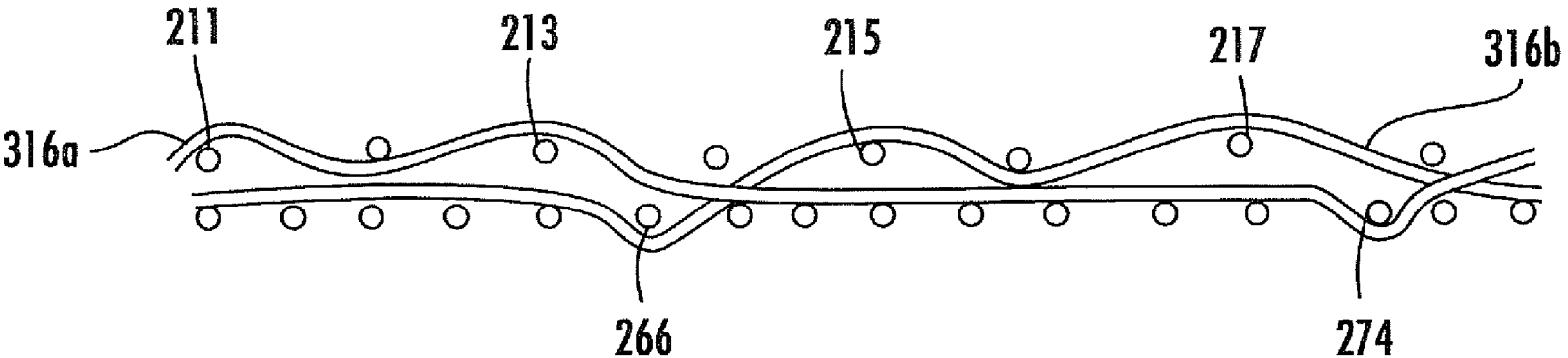
Figure 8A:
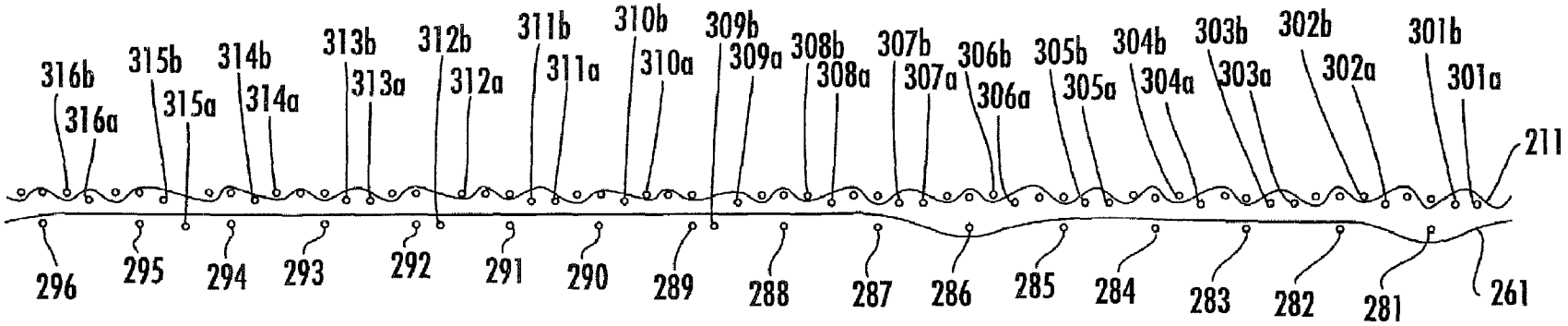
FIGS. 8A and 8B are section views taken along lines 8A-8A and 8B-8B, respectively, of the fabric of FIG. 6 showing typical MD yarns.
Figure 8B:
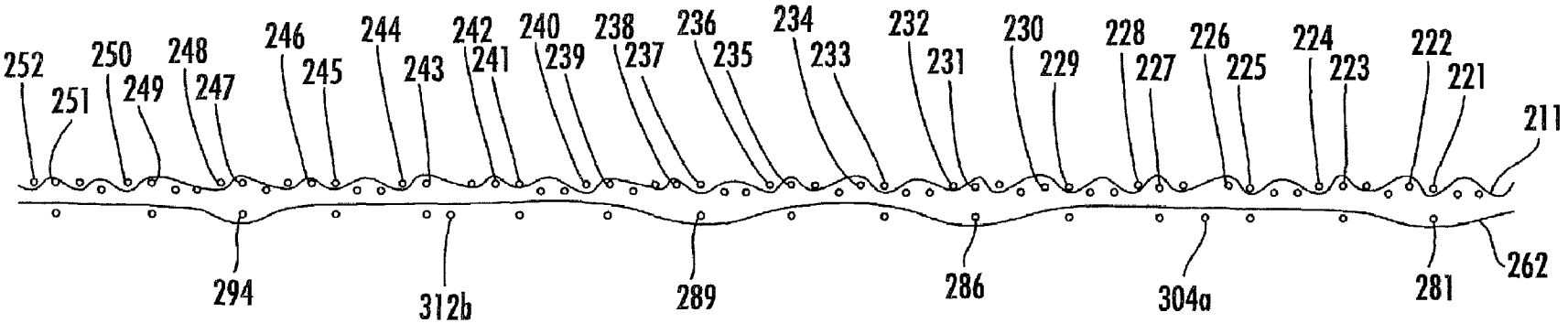

Referring now to FIG. 6, the bottom layer 210*b* of the fabric 200 includes the bottom MD yarns 261-276, the bottom CMD yarns 281-296, and the binding portions of the stitching yarns 301*a*, 301*b*-316*a*, 316*b*. The bottom MD yarns 261-276 are interwoven with the bottom CMD yarns 281-296 in two different sequences. The "odd-numbered" bottom MD yarns follow an "over 4/under 1/over 10/under 1" sequence. For example, referring to FIG. 8A, bottom MD yarn 261 passes above bottom CMD yarns 282-285, below bottom CMD yarn 286, above bottom CMD yarns 287-296, and below bottom CMD yarn 281. The other odd-numbered bottom CMD yarns follow a similar "over 4/under 1/over 10/under 1" weave pattern relative to the bottom CMD yarns, but each is offset from its nearest odd-numbered bottom MD yarn neighbors by two bottom CMD yarns. Thus, the odd-numbered bottom MD yarns enter or exit the bottom fabric layer 210*b* on four occasions forming two distinct MD "knuckles", each floating under one bottom CMD yarn, on the underside of the bottom fabric layer 210*b*.

In contrast, the even-numbered bottom MD yarns of the fabric 200 follow an "over 4/under 1/over 2/under 1/over 4/under 2/over 2/under 1" sequence as they interweave with the bottom CMD yarns 281-296 that is similar to that of the even-numbered bottom MD yarns of the fabric of FIGS. 1-4B. For example, referring to FIG. 8B, bottom yarn 262 passes over bottom CMD yarns 282-285, under bottom CMD yarn 286, over bottom CMD yarns 287 and 288, under bottom CMD yarn 289, over bottom CMD yarns 290-293, under bottom CMD yarn 294, over bottom CMD yarns 295 and 296, and under bottom CMD yarn 281. The remaining even-numbered bottom CMD yarns follow a similar weaving sequence, but are offset from their adjacent even-numbered neighbors by two bottom CMD yarns. Thus, the even-numbered bottom MD yarns enter or exit the bottom fabric layer 210*b* on eight occasions forming four distinct MD "knuckles", each knuckle being formed around a single bottom MD yarn, on the underside of this cloth.

Referring again to FIG. 6, as noted above, the bottom layer of the fabric 200 also includes the binding portions of the stitching yarns 301*a*, 301*b*-316*a*, 316*b*. In its binding portion, each stitching yarn 301*a*, 301*b*-316*a*, 316*b* passes below one bottom MD yarn in the repeat unit. One of three patterns is formed by the stitching yarn pairs: either an "over 7/under 1/over 7/under 1" pattern; an "over 9/under 1/over 5/under 1" pattern; or an "over 8/under 1/over 6/under 1" pattern (see FIG. 6). For example, stitching yarn 316*a* passes below bottom MD yarn 274, and stitching yarn 301*b* passes below bottom MD yarn 266; each of these stitching yarns pass above all of the other bottom MD yarns (see FIG. 7B). Thus, together these stitching yarns 301*a* and 301*b* follow the aforementioned "over 7/under 1/over 7/under 1" sequence relative to the bottom MD yarns 81-96. As an alternative example, stitching yarns 301*a*, 301*b* follow the "over 9/under 1/over 5/under 1" sequence, and stitching yarns 310*a*, 310*b* follow the "over 8/under 1/over 6/under 1" sequence. The stitching yarn binding portions are distributed so that two stitching yarns pass below each of the bottom MD yarns.

Referring once again to FIG. 2, despite the different interlacing pattern of the adjacent bottom MD yarns, each bottom CMD yarn follows a 2/7/1/6 pattern; for example, bottom CMD yarn 281 floats above two adjacent bottom MD yarns 261 and 262, under seven adjacent bottom MD yarns 263 to 269, and above bottom MD yarn 270 before floating under six adjacent bottom MD yarns 271 to 276.

Referring now to FIGS. 9-11B, a stylized representation of the bottom layer 300*b* of a fabric 300 includes sixteen bottom MD yarns 361-376, sixteen bottom CMD yarns 381-396, and binding portions of stitching yarn pairs 401*a*, 401*b*-416*a*, 416*b*. The bottom MD yarns 361-376 are interwoven with the bottom CMD yarns 381-396 in two different sequences. The "odd-numbered" bottom MD yarns follow an "under 2/over 3/under 2/over 1/under 2/over 3/under 2/over 1" sequence. For example, referring to FIGS. 9 and 10A, bottom MD yarn 361 passes under bottom CMD yarns 381, 382, above bottom CMD yarns 383-385, under bottom CMD yarns 386, 387, and above bottom CMD yarn 388 before repeating this sequence with the bottom CMD yarns 389-396. The other odd-numbered bottom MD yarns follow a similar weave pattern relative to the bottom CMD yarns, but each is offset from its nearest odd-numbered bottom MD yarn neighbors by two bottom CMD yarns. Thus, the odd-numbered bottom MD yarns enter or exit the bottom fabric layer 300*b* on eight occasions forming four distinct MD "floats", each floating under two bottom CMD yarns, on the underside of the bottom fabric layer 300*b*.

In contrast, the even-numbered bottom MD yarns of the fabric 300 follow an "under 1/over 4/under 1/over 2" sequence, repeated twice, as they interweave with the bottom CMD yarns 381-396. For example, referring to FIGS. 9 and 10B, bottom yarn 362 passes under bottom CMD yarn 387, over bottom CMD yarns 388-391, under bottom CMD yarn 392, and over bottom CMD yarns 393, 394, before repeating this sequence with the next eight bottom CMD yarns. The remaining even-numbered bottom CMD yarns follow a similar weaving sequence, but are offset from their adjacent even-numbered neighbors by two bottom CMD yarns. Thus, the even-numbered bottom MD yarns enter or exit the bottom fabric layer 300*b* on eight occasions forming four distinct MD "knuckles", each knuckle being formed around a single bottom CMD yarn, on the underside of the bottom fabric layer 300*b*.

Referring once again to FIG. 9, in addition to the different interlacing pattern of the adjacent MD yarns, even and odd CMD yarns have different paths. For example, odd-numbered bottom CMD yarns follow an "over 3/under 5" pattern (repeated twice). For example, bottom CMD yarn 381 floats under five adjacent bottom MD yarns 362-366 and passes over bottom MD yarns 367-369 before repeating this sequence with bottom MD yarns 370-381 and 361 (see FIG. 11A). By contrast, even-numbered bottom CMD yarns follow an "under 3/over 1/under 2/over 2" sequence before repeating on the next eight adjacent bottom MD yarns. For example, bottom CMD yarn 382 floats under bottom MD yarns 366-368, over bottom MD yarn 369, under bottom MD yarns 370, 371, and over bottom MD yarns 372, 373 before repeating the sequence on the next eight bottom MD yarns 374-376 and 361-365 (see FIG. 11B).

Figure 9:
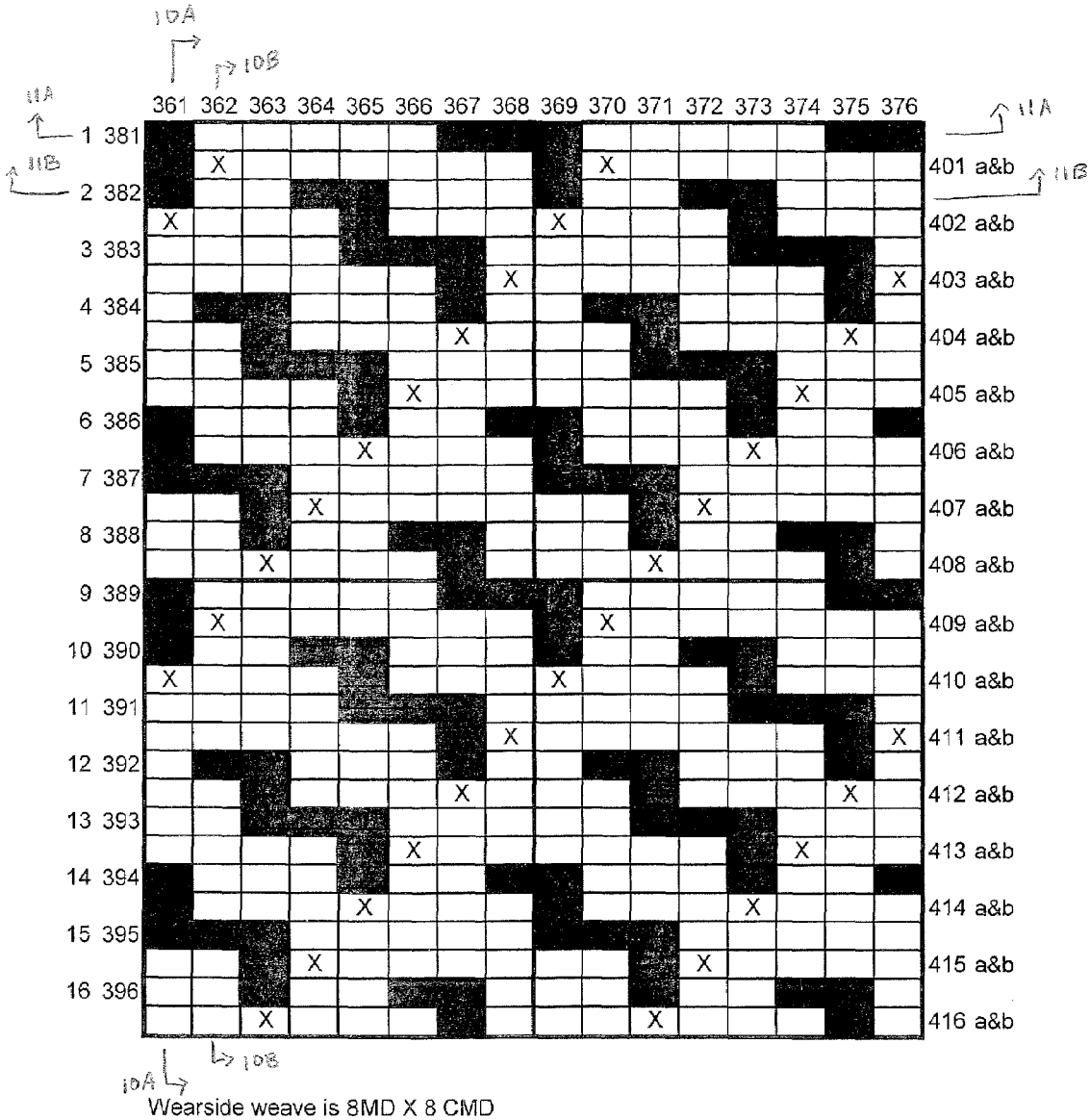
FIG. 9 is a stylized representation of the bottom layer of a repeat unit of a fabric according to embodiments of the present invention.

In the fabric 300 of FIG. 9, there are two distinct sets of bottom CMD yarns defined by their different weave paths. This particular aspect of the invention can be useful when using different materials for the bottom CMD yarns. When the materials have different physical characteristics, such that if given the same weave path the yarns would sit at relatively different planes on the fabric underside and interfere with the optimal performance of the fabric, then the use of different weave paths can compensate. This can be the case when, for example, one set of yarns utilizes polyester whereas another set uses polyamide to enhance fabric life.

It can be seen that, in the illustrated repeat units of the fabrics 10, 200, 300, there are sixteen bottom MD yarns and eight top MD yarns, i.e., that the ratio of top MD yarns to bottom MD yarns is 1:2. Generally speaking, and as discussed in the aforementioned U.S. Patent Publication No. 2005/0268981 to Barratte (the disclosure of which is hereby incorporated by reference herein in its entirety), the inclusion of more bottom MD yarns than top MD yarns can increase top surface open area and facilitate increased fiber support by top CMD yarns.

Fabrics of the present invention may provide performance benefits. For example, machine direction stability may increase due to fewer interlacing points in the bottom fabric layer, which can be important with finer MD yarns. In addition, the reduced interlacings in the bottom fabric layer can facilitate the inclusion of an increased number of CMD yarns per cm, which can improve wear resistance as fabrics get finer. In some embodiments, different CMD yarn types can be used with the MD yarns that bind differently in order to bring crimp height of the CMD yarns to the same level; this can increase life potential and reduce "strike-through". Other advantages may also be present.

Those skilled in this art will appreciate that fabrics of the present invention may take different forms. For example, different numbers of top and bottom machine direction yarns per repeat unit may be employed (e.g., four top MD yarns and eight bottom MD yarns, or 16 top MD yarns and 32 bottom MD yarns). Alternatively, the 1:2 top MD/bottom MD yarn ratio may vary (for example, a 2:3 ratio may be employed). As another example, different numbers of stitching yarn pairs per top CMD yarn may be used (e.g., there may be one stitching yarn pair for every top CMD yarn or for every three top CMD yarns, or alternatively two or three stitching yarn pairs for every top CMD yarn). As a further example, the number of top and/or bottom CMD yarns may vary. Also, the stitching yarns of a pair may interweave with different numbers of top CMD yarns, or one stitching yarn of the pair may only interweave with the top CMD yarns (see, e.g., International Patent Publication No. WO 2004/085741, the disclosure of which is hereby incorporated herein in its entirety). While the embodiments shown herein feature interchanging stitching pairs comprising two stitching yarns, the stitching pair may further comprise additional yarns which may also stitch and/or which form part of the paper side of the fabric. Stitching may alternatively be rendered by yarns that form no part of the paper side weave pattern. A further variation of the invention may comprise MD stitching yarns.

Moreover, the top surface of the fabric need not be a plain weave as illustrated, but may be satin, twill or the like, and the bottom surface of the fabric need not be a broken satin weave, but may take another form, such as a plain weave or twill. Other variations of weave patterns may also be employed with fabrics of the present invention. Yarns in one or both fabric layers may be paired and be positioned in a generally contiguous manner.

While the embodiments shown all feature alternating groups of bottom MD yarns disposed in an alternating manner, it is possible that yarns from both groups may be positioned directly adjacent to at least one yarn from the same group.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide may be suitable.

Those skilled in this art will appreciate that yarns of different sizes may be employed in fabric embodiments of the present invention. For example, the top MD yarns, top CMD yarns, and stitching yarns may have a diameter of between about 0.10 and 0.20 mm, the bottom MD yarns may have a diameter of between about 0.15 and 0.25 mm, and the bottom CMD yarns may have a diameter of between about 0.20 and 0.30 mm. The mesh of fabrics according to embodiments of the present invention may also vary. For example, the mesh of the top surface may vary between about 20×30 to 30×50 (epcm to ppcm), and the total mesh may vary between about 60×45 to 90×80.

A typical fabric with a 16 harness bottom layer according to embodiments of the present invention may have the characteristics set forth in Table 1.

TABLE 1

| Yarn Type | Size (mm) |
|---|---|
| Top MD | 0.12 |
| Bottom MD | 0.15 |
| Stitching Yarns | 0.11 |
| Top CMD | 0.12 |
| Bottom CMD | 0.25 |
| Mesh (top, epcm* × ppcm**) | 25 × 46 |
| (total) | 75 × 77 |

*ends per centimeter
**picks per centimeter

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A triple layer papermaker's fabric, comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units;

wherein the set of top MD yarns comprises a first number of top MD yarns in each repeat unit, and the set of bottom MD yarns comprises a second number of bottom MD yarns in each repeat unit, and wherein the second number is greater than the first number; and wherein each bottom MD yarn follows a different interweaving pattern than that followed by each of its two immediate neighboring bottom MD yarns.

2. The triple layer papermaker's fabric defined in claim 1, wherein a stitching yarn pair is positioned between each adjacent pair of top CMD yarns.

3. The triple layer papermaker's fabric defined in claim 1, wherein the set of top CMD yarns comprises a third number of top CMD yarns in each repeat unit, and wherein the set of bottom CMD yarns comprises a fourth number of bottom CMD yarns in each repeat unit, and wherein the third number is twice as large as the fourth number.

4. The triple layer papermaker's fabric defined in claim 1, wherein each stitching yarn of each pair interweaves with the bottom MD yarns.

5. The triple layer fabric defined in claim 4, wherein each of the stitching yarns passes below one bottom MD yarn.

6. The triple layer papermaker's fabric defined in claim 1, wherein together the top MD yarns, the top CMD yarns, and the stitching yarns form a plain weave pattern on a top surface of the fabric.

7. The triple layer papermaker's fabrics defined in claim 1, wherein each of the bottom MD yarns passes under a different number of bottom CMD yarns as its two immediate neighboring bottom MD yarns.

8. The triple layer papermaker's fabric defined in claim 1, wherein each of the bottom MD yarns passes under at least two bottom CMD yarns that one of its immediate neighboring bottom MD yarns passes under.

9. The triple layer papermaker's fabric defined in claim 7, wherein each of the bottom MD yarns passes under at least two bottom CMD yarns that one of its immediate neighboring bottom MD yarns passes under.

10. The triple layer papermaker's fabric defined in claim 1, wherein the mesh ratio of a top surface of the fabric is between about 20×30 and 30×50 epcm to ppcm.

11. The triple layer papermaker's fabric defined in claim 1, wherein each of the stitching yarns of a pair forms the same number of top side CMD knuckles as the other stitching yarn of that pair.

12. The triple layer papermaker's fabric defined in claim 1, wherein the second number is twice as great as the first number.

13. The triple layer papermaker's fabric defined in claim 1, wherein the first number is eight, and the second number is sixteen.

14. The triple layer papermaker's fabric defined in claim 3, wherein the third number is thirty-two, and the fourth number is sixteen.

15. A triple layer papermaker's fabric, comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units;

wherein the set of top MD yarns comprises a first number of top MD yarns in each repeat unit, and the set of bottom MD yarns comprises a second number of bottom MD yarns in each repeat unit, and wherein the second number is twice as great as the first number; and wherein each bottom MD yarn follows a different interweaving pattern than that followed by each of its two immediate neighboring bottom MD yarns.

16. The triple layer papermaker's fabric defined in claim 15, wherein a stitching yarn pair is positioned between each adjacent pair of top CMD yarns.

17. The triple layer papermaker's fabric defined in claim 15, wherein the set of top CMD yarns comprises a third number of top CMD yarns in each repeat unit, and wherein the set of bottom CMD yarns comprises a fourth number of bottom CMD yarns in each repeat unit, and wherein the third number is twice as large as the fourth number.

18. The triple layer papermaker's fabric defined in claim 15, wherein each stitching yarn of each pair interweaves with the bottom MD yarns.

19. The triple layer papermaker's fabric defined in claim 18, wherein each of the stitching yarns passes below one bottom MD yarn.

20. The triple layer papermaker's fabric defined in claim 15, wherein together the top MD yarns, the top CMD yarns, and the stitching yarns form a plain weave pattern on a top surface of the fabric.

21. The triple layer papermaker's fabric defined in claim 15, wherein each of the bottom MD yarns passes under the same number of bottom CMD yarns.

22. The triple layer papermaker's fabrics defined in claim 15, wherein each of the bottom MD yarns passes under a different number of bottom CMD yarns as its two immediate neighboring bottom MD yarns.

23. The triple layer papermaker's fabric defined in claim 15, wherein each of the bottom MD yarns passes under at least two bottom CMD yarns that one of its immediate neighboring bottom MD yarns passes under.

24. The triple layer papermaker's fabric defined in claim 22, wherein each of the bottom MD yarns passes under at least two bottom CMD yarns that one of its immediate neighboring bottom MD yarns passes under.

25. The triple layer papermaker's fabric defined in claim 15, wherein the mesh ratio of a top surface of the fabric is between about 20×30 and 30×50 epcm to ppcm.

26. The triple layer papermaker's fabric defined in claim 15, wherein each of the stitching yarns of a pair forms the same number of top side CMD knuckles as the other stitching yarn of that pair.

27. A method of making paper, comprising the steps of:

(a) providing a papermaker's fabric, the papermaker's fabric comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units;

wherein the set of top MD yarns comprises a first number of top MD yarns in each repeat unit, and the set of bottom MD yarns comprises a second number of bottom MD yarns in each repeat unit, and wherein the second number is greater than the first number; and wherein each bottom MD yarn follows a different interweaving pattern than that followed by each of its two immediate neighboring bottom MD yarns;

(b) applying paper stock to the papermaker's fabric; and (c) removing moisture from the paper stock.

28. A method of making paper, comprising the steps of:

(a) providing a papermaker's fabric, the papermaker's fabric comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units;

wherein the set of top MD yarns comprises a first number of top MD yarns in each repeat unit, and the set of bottom MD yarns comprises a second number of bottom MD yarns in each repeat unit, and wherein the second number is twice as great as the first number; and wherein each bottom MD yarn follows a different interweaving pattern than that followed by each of its two immediate neighboring bottom MD yarns;

(b) applying paper stock to the papermaker's fabric; and (c) removing moisture from the paper stock.

* * * * *